United States Patent [19]

Mashford

[11] 4,125,950

[45] Nov. 21, 1978

[54] SNOW PLOW ATTACHMENT

[76] Inventor: Donald R. Mashford, 5027 40th St., Innisfail, Alberta, Canada, T0M 1A0

[21] Appl. No.: 814,753

[22] Filed: Jul. 11, 1977

[51] Int. Cl.[2] ..... E01H 5/00; A01B 15/00

[52] U.S. Cl. ..... 37/41; 37/42 VL; 280/12 R; 172/387; 172/783; 172/188

[58] Field of Search ..... 37/42 R, 42 VL, 41, 37/50; 280/12 R, 12 K, 8; 172/393, 387, 188, 665, 738, 764, 783, 240, 729; 171/140

[56] References Cited

U.S. PATENT DOCUMENTS

| | | | |
|---|---|---|---|
| 1,443,032 | 1/1923 | Miscampbell | 37/46 |
| 1,473,889 | 11/1923 | Toy et al. | 37/46 |
| 1,887,451 | 11/1932 | Dombrowski | 280/12 R |
| 1,968,412 | 7/1934 | Lull | 172/783 |
| 2,108,541 | 2/1938 | Lull | 280/12 R |
| 2,611,979 | 9/1952 | Weller | 37/41 |
| 2,884,720 | 5/1959 | Meyer et al. | 37/47 |
| 3,659,363 | 5/1972 | Snyder | 37/42 R |

FOREIGN PATENT DOCUMENTS

| | | | |
|---|---|---|---|
| 131,668 | 5/1951 | Sweden | 172/783 |
| 727,806 | 4/1955 | United Kingdom | 172/393 |

*Primary Examiner*—E. H. Eickholt
*Attorney, Agent, or Firm*—Howard I. Podell

[57] ABSTRACT

A device adapted to be attached to a vehicle for plowing snow on gravel covered roads while minimizing loss of gravel caused by plowing which employs a horizontally elongated blade having a concave plowing front surface and a convex rear surface.

A horizontal foot is disposed below the blade and is adapted slidably to rest on the top of a gravel road covering. A mechanism secures said foot to said blade in such manner that the bottom edge of the blade is disposed above the foot. The mechanism is manually adjustable to adjust the vertical separation between the bottom edge of the blade and the bottom surface of the foot to a distance at which the gravel will not be removed and the snow can be suitably plowed when the device is used on a vehicle.

3 Claims, 4 Drawing Figures

SNOW PLOW ATTACHMENT

SUMMARY OF THE INVENTION

When gravel covered roads are covered with snow and snow plows are used to remove the snow, at least a portion of the gravel coating is normally removed at the same time. This damages the road bed, whereby repairs must be made and more gravel added, and at the same time produces undesired clumps of gravel where the plowed snow is stored.

This invention is directed toward a snow plow attachment, wherein the loss of gravel is minimized when the attachment is in use.

This invention is an improvement over previous devices such as those described in U.S. Pat. No. 2,108,541; and British Pat. No. 727,806.

The invention thus is a new device adapted to be attached to a vehicle for plowing snow on gravel covered roads while minimizing loss of gravel caused by plowing. This device comprises a horizontally elongated blade having a concave plowing front surface and a convex rear surface. A horizontal foot is disposed below the blade and is adapted to slidably rest on the top of the gravel covering. Means secures said foot to said blade in such manner that the bottom edge of the blade is disposed above the foot. This means is manually adjustable to adjust the vertical separation between the bottom edge of the blade and the bottom surface of the foot to a distance at which the gravel will not be removed and the snow can be suitably plowed when the device is used on a vehicle.

By this means, only the foot touches the gravel surface. The blade is raised so that its bottom edge does not engage the gravel and, therefore, does not remove the gravel. Savings on fuel cost and on less frequent blade replacement are obtained.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
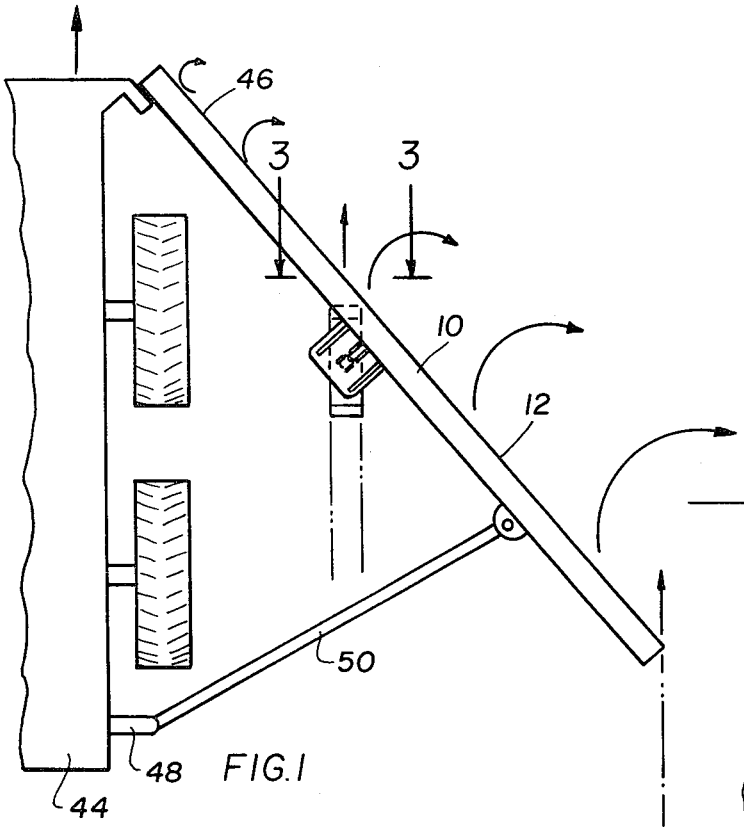
FIG. 1 is a plan view of the invention in use.
Figure 4:
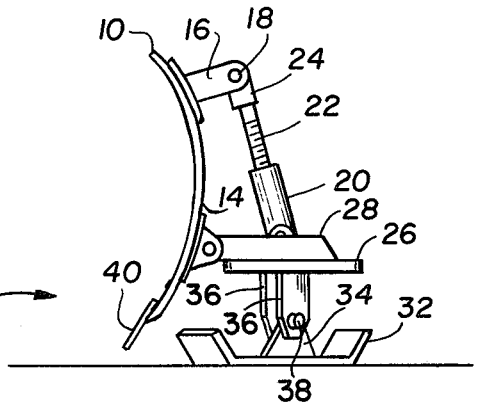
FIG. 4 is a detail view illustrating the level adjusting mechanism used in the invention.
Figure 3:
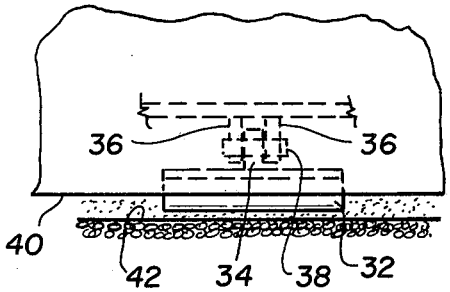
FIG. 3 is a detail view illustrating the position of the plowing blade when in use.
Figure 2:
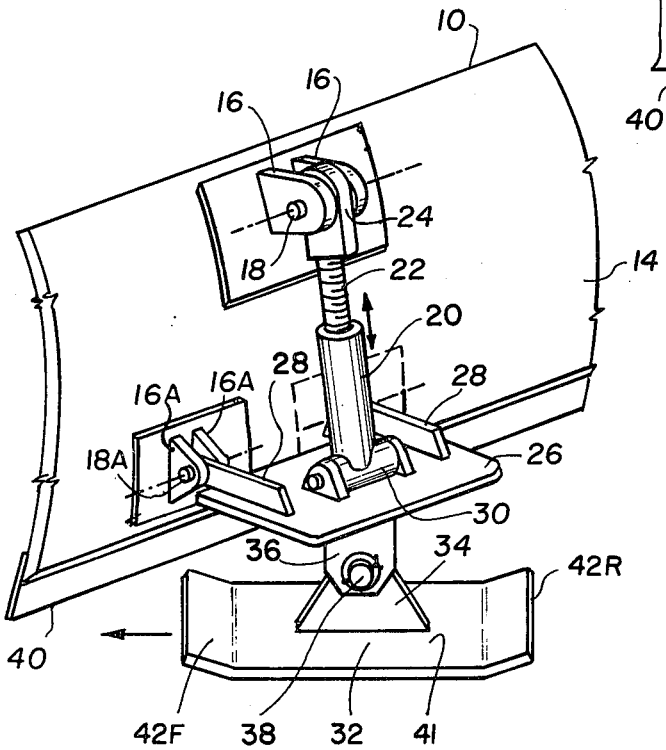
FIG. 2 is a rear perspective view of the blade and foot in accordance with the invention.

Referring now to FIGS. 1–4, a plow blade 10 extends horizontally with a concave front plowing surface 12 and a convex rear surface 14.

Two spaced metal plates 16 extend generally outward from the surface 14 adjacent the top horizontal edge. A horizontal pin 18 extends transversely between the plates as well as through aligned holes therein. The pin is removable.

A cylinder 20 has an axial threaded bore which is engaged by a lower end of threaded shaft 22. The upper end of this shaft is formed into an eye 24 which can be disposed between the plates and engaged by pin 18 whereby the upper end of the shaft is pivotally secured to the blade 10.

A generally horizontal member 26 has two parallel transversely disposed arms 28, each secured to the top surface and pivotally secured to the convex surface by spaced plates 16A and pins 18A in the same manner as the shaft. The bottom end of the cylinder is pivotally secured by a structure 30 to the top surface of member 26 to provide some freedom of motion to accommodate different vertical settings.

A horizontal foot 32 supports a vertical extension 34. Extension 34 is pivotally secured to parallel vertical plates by pin 38 and is disposed therebetween. Plates 36 are secured to the bottom of member 26.

The foot is thus disposed below the bottom horizontal edge 40 of the blade and rides on top of the gravel 42 when the device is in use whereby gravel loss is minimized.

By disconnecting the eye of the shaft from the pivot connection and rotating the shaft in the cylinder, the distance between the bottom of the foot and the bottom edge 40 can be varied as required. This adjustment is shown in detail in FIG. 4.

In use, one end 46 of the blade is secured to one side of the front end of a vehicle 44 while the same side of the rear end of a vehicle has an extension 48. One end of horizontal linkage 50 is pivotally secured to extension 48. The other end of linkage 50 is pivotally secured to the blade adjacent its other end. The invention is thus attached to the vehicle for use as described.

Foot 32 is preferably formed as a skid, with a flat plate section 41 joined at its forward and rear ends to upraised bent flanges 42F and 42R respectively to enable foot 32 to slide over bumps or irregularities associated with a gravel roadbed.

While the invention has been described with particular reference to the drawings, the protection sought is to be limited only by the terms of the claims that follow.

Having thus described the invention, what I claim as new and desire to secure by Letters Patent of the United States is:

1. A device adapted to be attached to a vehicle for plowing snow on gravel covered roads while minimizing loss of gravel caused by plowing, said device comprising a curved elongated blade having a concave plowing front surface and a convex rear surface, a horizontal foot disposed below the blade and adapted to rest on the top of the gravel covering; and means securing said foot to said blade in such manner that the bottom edge of the blade is disposed above the foot, said means being manually adjustable to adjust the vertical separation between the bottom edge of the blade and the bottom surface of the foot to a distance at which the gravel will not be removed and the snow can be suitably plowed when the device is used on a vehicle, while restraining rotation of the foot in a horizontal plane with respect to said blade, in which said means comprise a plate member fixed to a pair of spaced parallel arms each of which is pivotally mounted to the rear section of said blade, with the foot pivotally mounted to the underside of said plate member and with a first threaded member pivotally mounted to the underside of said plate member by pin and clevis means so as to pivot in a vertical plane, said first threaded member matingly engaged by its screw thread to the screw thread of a second threaded member pivotally mounted to the rear section of the blade, said pair of spaced parallel arms located to restrain rotational torque of the plate member and a foot in horizontal plane with relation to an attached blade.

2. The device defined in claim 1 in which the foot member is mounted to the plate member at a location generally midway between the arms.

3. The device defined in claim 2 in which the first threaded member is mounted to the plate member at a location generally midway between the arms.

* * * * *